US011619411B2

(12) United States Patent
Blincoe et al.

(10) Patent No.: US 11,619,411 B2
(45) Date of Patent: Apr. 4, 2023

(54) HVAC MONITORING SYSTEM

(71) Applicants: Rodney Craig Blincoe, Highlands Ranch, CO (US); Adam Roller, Golden, CO (US); Kathryn Huonder, Erie, CO (US); Tariq Al Salmani, Lakewood, CO (US)

(72) Inventors: Rodney Craig Blincoe, Highlands Ranch, CO (US); Adam Roller, Golden, CO (US); Kathryn Huonder, Erie, CO (US); Tariq Al Salmani, Lakewood, CO (US)

( * ) Notice: Subject to any disclaimer, the term of this patent is extended or adjusted under 35 U.S.C. 154(b) by 0 days.

(21) Appl. No.: 17/981,422

(22) Filed: Nov. 6, 2022

(65) Prior Publication Data

US 2023/0054981 A1 Feb. 23, 2023

Related U.S. Application Data

(63) Continuation of application No. 17/585,583, filed on Jan. 27, 2022, now Pat. No. 11,519,622.

(Continued)

(51) Int. Cl.

| | |
|---|---|
| ***F24F 11/38*** | (2018.01) |
| ***F24F 11/88*** | (2018.01) |
| ***F24F 11/56*** | (2018.01) |
| ***F24F 11/33*** | (2018.01) |
| ***F24F 11/61*** | (2018.01) |
| ***F24F 11/89*** | (2018.01) |
| ***F24F 11/526*** | (2018.01) |

(52) U.S. Cl.

CPC ..... *F24F 11/38* (2018.01); *F24F 11/33* (2018.01); *F24F 11/526* (2018.01); *F24F 11/56* (2018.01); *F24F 11/61* (2018.01); *F24F 11/88* (2018.01); *F24F 11/89* (2018.01)

(58) Field of Classification Search

CPC F24F 11/38; F24F 11/33; F24F 11/526; F24F 11/56; F24F 11/61; F24F 11/88; F24F 11/89

See application file for complete search history.

(56) References Cited

U.S. PATENT DOCUMENTS 3,202,209 A * 8/1965 Otto ..... F24F 5/0007 165/286
4,687,050 A * 8/1987 Podlipnik ..... G05D 23/1928 236/1 C (Continued)

*Primary Examiner* — Nelson J Nieves
(74) *Attorney, Agent, or Firm* — Roger A. Jackson

(57) ABSTRACT

An HVAC monitoring system that tests for an abnormal environmental condition, wherein the abnormal condition results in effectuating a selected response from an HVAC building system, the HVAC monitoring system utilizing an existing sensor for detecting the gas abnormal condition, wherein a first event marker signal is generated from the existing sensor detecting the abnormal condition. Further included is an audio sensor, a wireless transmitter, a wireless receiver, programmable control circuitry, a switching transistor, a relay, and a power supply for all the previous elements, wherein these components utilize the first event marker signal and through a series of subsequent signals to result in the relay being operative to be in an activated operational state upon being energized by the switching transistor to operationally effectuate the selected response from the HVAC building system.

7 Claims, 8 Drawing Sheets

Related U.S. Application Data

(60) Provisional application No. 63/224,761, filed on Jul. 22, 2021, provisional application No. 63/143,040, filed on Jan. 29, 2021.

(56) References Cited

U.S. PATENT DOCUMENTS 5,197,862 A * 3/1993 Kladder ..... G01F 1/00 417/63
6,779,735 B1 * 8/2004 Onstott ..... F24F 12/006 165/267
10,240,809 B1 * 3/2019 Duvivier ..... F24F 11/88
11,125,457 B1 * 9/2021 Alfano ..... F24F 11/56
2002/0097574 A1 * 7/2002 Wu ..... F21S 4/10 362/185
2003/0126869 A1 * 7/2003 Liu ..... F24F 1/027 62/262
2004/0182942 A1 * 9/2004 Head ..... F24F 11/89 374/147
2005/0031503 A1 * 2/2005 Fox ..... F24F 8/192 422/186.04
2006/0154596 A1 * 7/2006 Meneely ..... F24F 11/77 454/239
2007/0206661 A1 * 9/2007 Okada ..... A61B 1/00016 375/141
2008/0198524 A1 * 8/2008 McConnell ..... F23M 11/00 361/91.2
2011/0062888 A1 * 3/2011 Bondy ..... H05B 45/10 315/294
2012/0248211 A1 * 10/2012 Warren ..... F24F 11/58 236/1 C
2015/0077243 A1 * 3/2015 Hooper ..... G08B 17/06 340/532
2016/0187020 A1 * 6/2016 Ishii ..... F24F 11/30 700/276
2017/0176027 A1 * 6/2017 Eicher ..... F24F 13/28
2017/0193789 A1 * 7/2017 Economy ..... G08B 21/14
2017/0337787 A1 * 11/2017 Bryce ..... F24F 11/523
2018/0023828 A1 * 1/2018 Lutz ..... F24F 11/62 700/276
2018/0190459 A1 * 7/2018 Situ ..... F24F 9/00
2019/0089156 A1 * 3/2019 Kim ..... H02J 3/02
2020/0355385 A1 * 11/2020 Liang ..... F25B 49/022
2021/0108823 A1 * 4/2021 Takagi ..... F24F 11/89
2021/0222877 A1 * 7/2021 Combe ..... E05F 15/72
2021/0265106 A1 * 8/2021 Salunkhe ..... F24F 11/88

* cited by examiner

HVAC MONITORING SYSTEM

RELATED PATENT APPLICATIONS

This application is a continuation in part of U.S. patent application Ser. No. 17/585,583 filed on Jan. 27, 2022 by Rodney Craig Blincoe of Highlands Ranch, Colo., U.S., Adam Roller of Golden, Colo., U.S., Kathryn Huonder of Erie, Colo., U.S., and Tariq Al Salmani of Lakewood, Colo., U.S., that claims the benefit of U.S. provisional patent application Ser. 63/143,040 filed on Jan. 29, 2021 by Rodney Craig Blincoe of Highlands Ranch, Colo., U.S. and this patent application also claims the benefit of U.S. provisional patent application Ser. No. 63/224,761 filed on Jul. 22, 2021 by Rodney Craig Blincoe of Highlands Ranch, Colo., U.S.

TECHNICAL FIELD

The present invention relates generally to a system for sending electrical signals. More specifically, the present invention relates to the field of building fire safety and control of building systems in the event of a building fire.

BACKGROUND OF INVENTION

Commercial buildings have long had additional fire safety procedures, inspections, and systems that residential buildings (housing) have typically not had, such as auto fire department calling when a fire detectors go off or when the building fire sprinkler system starting flowing, or when an exit door is opened. Further, commercial buildings can have Heating Ventilation and Air Conditioning (HVAC) systems automatically shutdown in the event of a fire to prevent spreading of toxic smoke, feeding the fire extra oxygen, or excessive cooling by the air conditioning system. Also, commercial systems have items like battery powered lighted EXIT signs in the event of electrical failure and smoke present and same goes for emergency stairway and hall lighting, in addition to automatic closing of fire doors for fire suppression, automatic elevator height level defaults for fireman to use, auto ventilation systems for removing smoke, and the like.

However, for residential buildings, fire safety has been minimal or at a much lower level, which is curious as people sleep at home, while they are awake at commercial buildings, i.e. while at work. So, in a sense, people are at more risk for fire danger at home while sleeping. It is interesting that building fire codes are typically much more strict for commercial buildings (where occupants are typically awake and alert) verses residential buildings (where occupants sleep and have higher risks for smoking, candles, fireplaces, and the like that typically don't exist in commercial buildings). Because of this there is a definite need for commercial type fire safety protection for residential buildings to enhance the safety of people in their homes, i.e. with a focus on automated systems that activate home building systems to enhance fire safety even while the home occupants are sleeping. There has been some activity in this area with KIDDE fire detectors that have wireless communication to one another, i.e. such that if there are multiple fire detectors within a single house and that if a single fire detector activates, then all the fire detectors alarm for notifying a house occupant that is located in the house in a remote area from the location of the original fire detection.

In looking at the prior art in the residential building digital transmission and data switching arts in U.S. Pat. No. 9,286,781 to Filson et al., discloses a smart home system that is assigned to Google that teaches digital interconnection between components that includes a thermostat, a fire detector, and cameras, using sensors that include smoke, audio, acceleration, seismic, temperature, humidity, and radiation, with all sensors communicating to an event processor that further analyzes the combination of sensor inputs to help ascertain whether an earthquake, tornado, power outage, or weather event has likely occurred, thus this system is primarily for notification purposes rather than any automated equipment change of operational state being effectuated.

Further in the above prior art area in U.S. Pat. No. 6,891,838 to Petite et al., disclosed is a monitoring and controlling system for residential buildings that includes a sensor that outputs a sensor data signal, a processor to format the sensor data signal for a particular function to evaluate the parameter for the sensor, and to create a follow on signal based on selected parameter values.

Continuing in the above prior art area in U.S. Pat. No. 10,403,127 to Sloo et al., disclosed is a smart home device that is assigned to Google wherein the smart home device provides follow up communications for detection events; the device includes a sensor that detects a dangerous condition in a home environment, a processor that determines a first state of moderate danger and then an second state then having the ability to determine whether the danger has ceased based on the first and second states. Again, this is a notification type system rather than an automated equipment change of operational state in reaction to sensor outputs.

Next in the above prior art area in U.S. Pat. No. 10,331,095 to Patel et al., discloses a method and system for an automation control device that includes a processor that is configured in response to receive an input message, map the message to a control message, and to determine a control action for the automation control asset.

Continuing in the above prior art area in U.S. Pat. No. 10,282,787 to Hakimi-Boushehri et al., disclosed is a system for determining a loss to a property that is assigned to State Farm Insurance, wherein the system includes a smart home controller that monitors a sensor that has data stored a baseline level of data, wherein when the sensor provides data outside of the baseline the controller will determine damage to the property based on the sensor input, and engaging in automated insurance company form submittal.

Moving onward in the above prior art area in U.S. Pat. No. 10,158,498 to Brandman et al., discloses a building sensor monitoring and control system that is assigned to the Hartford Fire Insurance Company, wherein the system includes multiple sensors that generate electronic signals that are evaluated for a risk situation, wherein signals with unique instructions are generated to try to mitigate the situation at the electromechanical device and if the conditions are not mitigated the system changes control parameters.

Further in the above prior art area in U.S. Pat. No. 10,361,878 to Loreille, discloses a system for initiating actions automatically on home smart devices that starts with a movement sensor action trigger signal that causes an action to initiate video recording and record a log.

Continuing in the prior art in U.S. Pat. No. 10,726,695 to Blincoe, disclosed is a building safety system that receives a first communication from a fire sensing appliance and translates the first communication to a building system to effectuate a selected response from the building system. The building safety system in Blincoe includes control circuitry in a ready state that is operative to monitor the first communication and to produce a first event market signal upon receipt of the first communication, the first event market signal is in a first electrical communication with the building system, wherein operationally the first event marker signal effectuates the selected response from the building system.

What is needed is a HVAC monitoring system that is positioned to fill a void in residential building fire protection being the failure to shut off the central ventilation system blower (HVAC) in the case of fire. In the event of a residential house fire when the HVAC unit is activated, the air blower (air conditioning) ramps up to compensate for the heat which further feeds the fire with oxygen from the air and spreads toxic gasses and smoke throughout the house further making the fire worse.

Currently in the prior art the vast majority of installed residential building fire alarm systems alert the user with a high-audible volume alarm appliance to allow the occupants to escape safely but do nothing to reduce the severity of the fire. The present invention is desirably easy to install and inexpensive that adds a layer of protection to residential buildings to help save lives and to help reduce property loss.

SUMMARY OF INVENTION

Broadly, the present invention is an HVAC monitoring system that tests for an environmental abnormal condition defined as an event marker, utilizing an existing sensor that outputs an available first event marker signal along a first communication when detecting the environmental abnormal condition, wherein the environmental abnormal condition through the HVAC monitoring system effectuates a selected response from an existing HVAC building system that includes an existing HVAC control circuit board with an electrical utility alternating current neutral wire leg and a fan door switch with an electrical utility alternating current hot wire leg.

The HVAC monitoring system includes a first electrical power supply that receives an alternating current supply system electrical power switched hot leg from the HVAC fan door switch and an electrical utility alternating current neutral wire leg from the existing HVAC control circuit board, the first electrical power supply includes a first electrical buck convertor transformer receiving the switched hot leg and the neutral wire leg. Wherein the first electrical buck convertor transformer outputs a first reduced alternating current voltage with the reduced voltage being compatible with electrical power requirements of the existing HVAC control circuit board. The first electrical power supply further includes a full wave bridge rectifier circuit with a wave smoothing capacitor and resistor for more consistent voltage resulting in an output that converts the first reduced alternating current voltage to a first reduced voltage direct current to be more fully compatible with electrical power requirements of the existing HVAC control circuit board. The first electrical power supply also includes a second electrical buck convertor transformer receiving the existing HVAC control circuit board compatible reduced voltage direct current, wherein the second electrical buck convertor transformer outputs a second reduced direct current voltage with the second reduced direct current voltage being compatible with electrical power requirements of a semiconductor printed circuit board.

Further included in the HVAC monitoring system is a second electrical power supply that is adapted to receive alternating current supply electrical power from a building wall electrical outlet, the second electrical power supply outputs a third reduced direct current voltage with the third reduced direct current voltage being compatible with electrical power requirements of a semiconductor printed circuit board. Also, a programmable audio frequency sensor that receives input electrical power from the third reduced direct current voltage, operationally the programmable audio frequency sensor scans for the environmental abnormal condition as indicated by the existing sensor that outputs the available first event marker signal, wherein the programmable audio frequency sensor is operative to monitor for the available first event marker signal and when the first event marker signal is received results in the programmable audio frequency sensor outputting a second event marker signal along a second communication.

Additionally included in the HVAC monitoring system is a programmable radio frequency transmitter that receives input electrical power from the third reduced direct current voltage, the programmable radio frequency transmitter is operative to monitor for the second event marker signal and when the second event marker signal is received results in the programmable radio frequency transmitter outputting a third event marker signal along a third communication. Further, a programmable radio frequency receiver that receives input electrical power from the second reduced direct current voltage, the programmable radio frequency receiver is operative to monitor the third event marker signal and when the third event marker signal is received results in the programmable radio frequency receiver outputting a fourth event marker signal along a fourth communication. In addition, programmable control circuitry that receives input electrical power from the second reduced direct current voltage, the programmable control circuitry is in a ready state being operative to monitor for the fourth event marker signal and when the fourth event marker signal is received results in the control circuitry outputting a fifth event marker signal along a fifth communication.

Further included in the HVAC monitoring system is a switching transistor having a base connection, a collector connection, and an emitter connection, the base connection is in electrical communication with the fifth communication and is operative to receive the fifth event marker signal and when the fifth event marker signal is received results in the collector connection and the emitter connection being placed from a transistor open electrical communication state to a transistor closed electrical communication state to facilitate electrical communication from the collector connection to the emitter connection.

Continuing, a normally closed electrical relay that receives input electrical power from the first reduced voltage direct current being a positive leg only to a primary terminal of the normally closed electrical relay, wherein the first reduced voltage direct current being compatible with the electrical power requirements of the existing HVAC control circuit board. The normally closed electrical relay is also in electrical communication to the switching transistor collector connection through a secondary terminal on the normally closed electrical relay, the normally closed electrical relay switched leg is disposed in electrical communication as between an existing HVAC control circuit board fan relay output connector and an existing HVAC fan motor relay resulting in operationally the normally closed electrical relay controlling building full voltage alternating current electrical power to an existing HVAC fan motor that results in the existing HVAC fan motor being operational when the normally closed electrical relay is in an un-activated operational state such that the normally closed electrical relay is in a closed state.

When the normally closed electrical relay is in an activated operational state from allowing electrical communication from the secondary terminal to a negative ground of the first reduced voltage direct current therethrough the collector connection to the emitter connection, resulting in the normally closed electrical relay switched leg moving to an open state resulting in the existing HVAC fan motor being deactivated.

These and other objects of the present invention will become more readily appreciated and understood from a consideration of the following detailed description of the exemplary embodiments of the present invention when taken together with the accompanying drawings, in which;

BRIEF DESCRIPTION OF DRAWINGS

FIG. 6 shows an electrical schematic of the HVAC monitoring system from FIG. 5, wherein FIG. 6 is in the alternative environmental abnormal condition state with the relay in the open position facilitating the disabled state of the existing fan blower motor with the power supply electrical schematic not shown for clarity (as the power supply electrical schematic is detailed in FIG. 4), thus shown in FIG. 6 in a summary manner is the wireless signal from the existing sensor to the audio frequency sensor that is in electrical communication with the programmable radio frequency transmitter that is in wireless communication with the programmable radio frequency receiver that is in electrical communication with the programmable control circuitry that in turn is in electrical communication with the switching transistor that is displaced between the electrical power supply for the existing HVAC control circuit board and the existing HVAC control circuit board ground, wherein in the alternative environmental abnormal condition state the switching transistor is closed thus resulting in the relay being energized thus the relay being moved to the open operational state resulting in the HVAC blower motor in the disabled operational state;

REFERENCE NUMBERS IN DRAWINGS

50 HVAC Monitoring System

Figure 1:
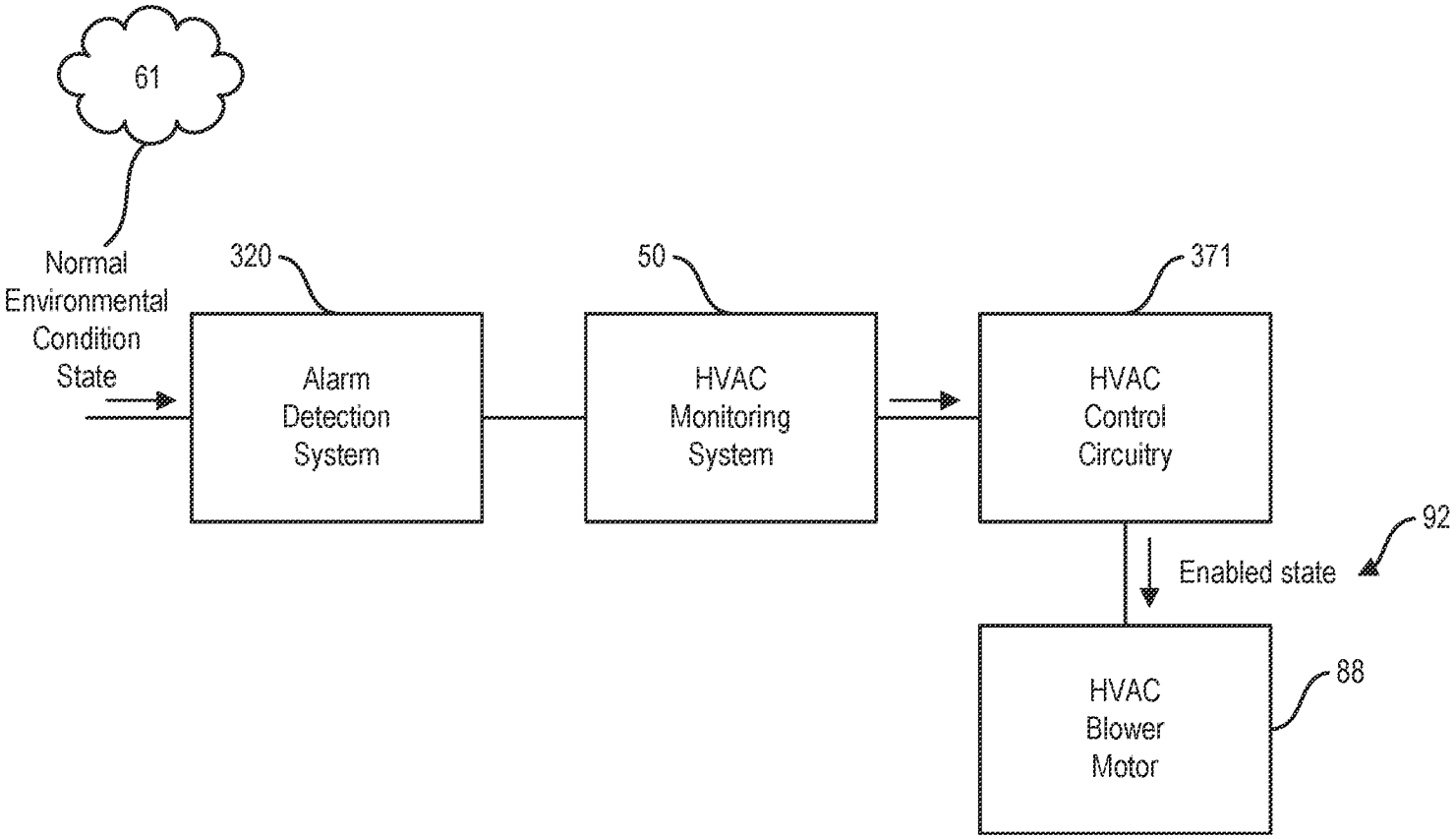
FIG. 1 shows a summary schematic diagram of the HVAC monitoring system in the normal environmental condition operational state with the HVAC blower motor in the normal enabled operational state.

55 Environmental abnormal or emergency condition state which can be typically air that is contaminated

60 Environmental abnormal condition state which can be smoke in the air

61 Normal environmental condition state

65 Existing HVAC building system that typically includes the return duct 70, the exit duct 75, the thermostat 80, the fan 85, the heating element 90, and the cooling element 95, the fan 85, and the fan motor 88, and the HVAC control circuit board 371

70 Return duct of the HVAC building system 65

75 Exit duct of the HVAC building system 65

76 Enclosure of the fan 85 and fan motor 88

77 Access door opening of the enclosure 76

80 Thermostat of the HVAC building system 65

81 Existing door switch of the fan 85 and fan motor 88 disposed as between the access door 77 and the enclosure 76 of the existing HVAC building system 65

85 Fan/blower of the HVAC building system 65

87 Filter of the fan 85

88 Motor of the fan/blower 85

89 Existing relay of the fan 85 motor 88

90 Heating element of the HVAC building system 65

91 Disabled/deactivated state of the fan motor 88

92 Enabled state of the fan motor 88

95 Cooling element of the HVAC building system 65

105 Selected response from of the HVAC building system 65 typically being the deactivation/disabled state 91 of the HVAC building 65 fan 85 via the fan motor 88

106 Hot wire 110 VAC building electrical power 830 feed to the HVAC monitoring system 50 or more specifically power supply circuitry 107 or first electrical power supply circuitry 701

107 Power supply circuitry of the HVAC monitoring system 50

108 Neutral wire 110 VAC building electrical power 830 feed to the HVAC monitoring system 50 or more specifically power supply circuitry 107 or first electrical power supply circuitry 701

140 Fire

165 Residential or commercial building

166 Interior of the residential or commercial building 165

167 Exterior of the residential or commercial building 165

170 HVAC air outlet or outlet air movement

175 HVAC air inlet or inlet air movement

205 Available existing first event marker signal from the existing sensor 320 to the programmable audio frequency sensor 810 in the form of sound waves 790 and/or radio frequency 791 through the existing first communication 215

215 Available existing first communication for the existing first event marker signal 205 that can be between the existing sensor 320 to the programmable audio frequency sensor

810 in the form of sound waves 790 and/or radio frequency 791

220 Second event marker signal from the programmable audio frequency sensor 810 to the programmable radio frequency transmitter 805 during the environmental abnormal condition state 55 which can be typically air that is contaminated or the environmental abnormal condition state which can be smoke in the air 60

225 Relay that is in the normally closed operational state for the existing fan 85 and motor 88 that is preferably a UXCELL model A14060500ux1280

226 Activated operational state of the relay 225 in the open operational state resulting in the disabled state 91 of the fan motor 88

227 Un-activated/deenergized operational state of the relay 225 in the normally closed operational state resulting in the enabled state 92 of the fan motor 88 as long as the existing HVAC control circuitry 371 is in the enabled state 92 of the fan motor 88

228 Primary terminal of the relay 225

229 Secondary terminal of the relay 225

230 Second communication of the second event marker signal 220 that can be between the programmable audio frequency sensor 810 and the programmable radio frequency transmitter 805

235 Structural ductwork of the return duct 70 of the HVAC building system 65

240 Existing sensor 320 that can be disposed partially within the structural ductwork 235

245 Gas 55 flow of the structural ductwork 235

250 Sidewall of the structural ductwork 235

255 Probe extension of the existing sensor 320

260 Interior of the structural ductwork 235

270 Outside of the sidewall 250

320 Existing sensor, wherein the existing sensor can be but not limited to detecting the environment abnormal condition 55, 60 that is selected from the group including; audio alarms, ambient temperature, smoke ionization, smoke optical, smoke photoelectric, catalytic combustible gas sensor for; natural gas, hydrogen, or propane, a carbon monoxide detector, or an ultraviolet infrared flame detector, although the existing sensor

320 is shown disposed in the structural ductwork 235 interior 260, the existing sensor 320 can be located anywhere within the interior 166 of the building 165 or even proximate to the exterior 167 of the building 165

371 Existing HVAC control circuitry board of the existing HVAC building system 65

372 Existing HVAC control circuitry 371 electrical neutral leg power feed, typically 110 VAC, connector from the building utility electrical power 830

373 Existing electrical hot leg power feed, typically 110 VAC, 106 connector on the input of the existing HVAC building system 65 fan 85 door switch 81 from the building utility electrical power 830

375 Existing HVAC control circuitry 371 fan 85 motor 88 relay output connector

376 Disconnect point of the existing electrical communication as between existing fan 85 motor 88 relay output connector 375 and the existing fan 85 motor 88 relay 89, this modification is done to force the electrical communication from the existing relay output connector 375 to the existing fan 85 motor 88 relay 89 therethrough the HVAC monitoring system 50 to enable the HVAC monitoring system to control the fan 85 motor 88 disabling during the abnormal environmental condition 55, 60 and when there is a normal environmental condition 61, the HVAC monitoring system 50 allows electrical communication from the existing relay output connector 375 to the existing fan 85 motor 88 relay 89 for normal existing HVAC control circuitry operation, i.e. fan 85 motor 88 delay upon the existing HVAC building system 65 heat exchanger warm-up, and prolonged fan 85 motor 88 operation for existing HVAC building system 65 heat exchanger cool down after the existing gas burner is deactivated.

377 Fan relay inlet connection for the HVAC monitoring system 50 from the existing HVAC control circuitry 371 existing HVAC control circuitry fan 85 motor 88 relay output connector 375

378 Hot wire leg electrical power outlet from the existing door switch 81

379 Electrical communication from hot wire leg electrical power outlet 378 to the hot wire 110 VAC building electrical power 830 feed 106 to the HVAC monitoring system 50, being defined as Hot 1

380 Electrical communication from the existing electrical neutral leg power feed 372 to the neutral wire 110 VAC building electrical power 830 feed 108 to the HVAC monitoring system 50 or more specifically to the power supply circuitry 107 or first electrical power supply circuitry 701

381 Fan relay outlet connection from the HVAC monitoring system 50 to the existing fan 85 motor 88 relay 89

382 Electrical communication defined as Fan 1 from the existing HVAC control circuitry fan 85 motor 88 relay output connector 375 to the fan relay inlet connection 377

383 Electrical communication defined as Fan 2 from the fan relay outlet connection 381 to the existing relay 89 of the fan 85 motor 88

384 Existing electrical communication that is broken at disconnect point 376 from the existing HVAC control circuitry 371 fan 85 motor 88 relay output connector 375 to the existing fan 85 motor 88 relay 89

700 Programmable control circuitry that is preferably an ARDUINO UNO model ELEGOO-UNO-R3

701 First electrical power supply that includes elements 106, 379, 380, 108, 715, 705, 800, 720, 765, 770, 775, 725, 710, 730, and 731

705 Electrical buck converter 1 first transformer that is preferably a HAMMOND model 187020 taking 110 VAC building wall electrical power 830 to about 24 VAC

710 Electrical buck converter 2 second transformer that is preferably an EBOOT MINI model MP1584EN being DC to DC taking 24 VDC used in existing HVAC control circuitry 371 to about 5 VDC used for printed circuit boards such as programmable control circuitry 700 and programmable radio frequency receiver 780

715 Electrical input being 110 VAC of the electrical buck converter 1 transformer 705

720 Electrical output being about 24 VAC 800 of the electrical buck converter 1 transformer 705

725 Electrical input being about 24 VDC of the electrical buck converter 2 transformer 710 being the first reduced direct current voltage

730 Electrical output being about 5 VDC 731 of the electrical buck converter 2 transformer 710

731 Second reduced DC voltage

735 Electrical resister R1 preferably about 2.2K ohms for current limiting

740 Electrical communication from the electrical output being about 5 VDC 730 to programmable control circuitry 700

745 Electrical communication from the electrical input being about 24 VDC 725 to the relay that is in the normally closed operational state 225

750 Switching transistor being preferably a CENTRAL SEMICONDUCTOR CORPORATION model TIP 120

755 Diode is preferably a SMC DIODE SOLUTIONS model 1N4004

760 Fifth event marker signal from the programmable control circuitry 700 in operational state being the environmental abnormal condition 55, 60 to switching transistor 750 "base" leg

761 Fifth communication of the fifth event marker signal 760 as between the programmable control circuitry 700 pin 13 and the switching transistor 750 "base" leg

765 Full wave bridge rectifier diodes D1, D2, D3, D4 that are preferably MXUTEUK electronic silicon diodes model M-021

770 Capacitor rectified wave smoothing preferably rated at 470 micro-Farads

775 Resistor R2 for voltage control preferably rated at 10K ohms

780 Programable radio frequency receiver that is preferably a KWMOBILE model MX-05V

785 Fourth event marker signal from the programmable radio frequency receiver 780 to the programmable control circuitry 700 to pin 11

786 Fourth communication of the fourth event marker signal 785 from the programmable radio frequency receiver 780 to the programmable control circuitry 700 to pin 11

790 Sound waves being the first event marker signal 205 along the first communication 215 from the existing sensor 320 to the programmable audio frequency sensor 810

791 Radio frequency waves alternatively being the first event marker signal 205 along the first communication 215 from the existing sensor 320 to the programmable audio frequency sensor 810

795 Third event marker signal from the programmable radio frequency transmitter 805 to the programmable radio frequency receiver 780 that is preferably a wireless signal

796 Third communication of the third event marker signal 795 from the programmable radio frequency transmitter 805 to the programmable radio frequency receiver 780 that is preferably a wireless communication for the third communication 796

800 First reduced AC voltage

805 Programable radio frequency transmitter that is preferably a KWMOBILE model MX-FS-03V

810 Programable audio frequency sensor that is preferably a DEVMO with UPC 741722788615 or alternatively can be another sensor type but not limited to detecting the environment abnormal condition 55, 60 that is selected from the group including; ambient temperature, smoke ionization, smoke optical, smoke photoelectric, catalytic combustible gas sensor for; natural gas, hydrogen, or propane, a carbon monoxide detector, or an ultraviolet infrared flame detector

815 Second electrical power supply that takes standard building wall outlet electrical power 830 being 110 VAC and converting to 5 VDC printed circuit board power for the elements being the programmable audio frequency sensor 810 and programmable radio frequency transmitter 805, note the reason for the second electrical power supply 815 from the first electrical power supply 701 is to accommodate the remote wireless location of the programmable audio frequency sensor 810 and programmable radio frequency transmitter 805 that use the second electrical power supply 815 in relation to the first electrical power supply 701 and the other elements 700, 780, 750, 225, and 755 being in a different location with wireless communication 795, 796 as between the radio frequency transmitter 805 and the programmable radio frequency receiver 780, preferably the second electrical power supply 815 is a CORPORATE COMPUTER model LJH-186

820 Input electrical power 110 VAC 830 of the second electrical power supply 815

825 Output electrical power that is a third reduced direct current voltage output being 5 VDC of the second electrical power supply 815 to provide an electrical power supply for the programmable audio frequency sensor 810 and the programmable radio frequency transmitter 805

830 Standard building wall outlet electrical power being 110 VAC

DETAILED DESCRIPTION

With initial reference to FIG. 1 shows a summary schematic diagram of the HVAC monitoring system 50 in the normal environmental condition operational state 61 with the HVAC blower fan 85 motor 88 in the normal enabled operational state 61, 92.

Figure 2:
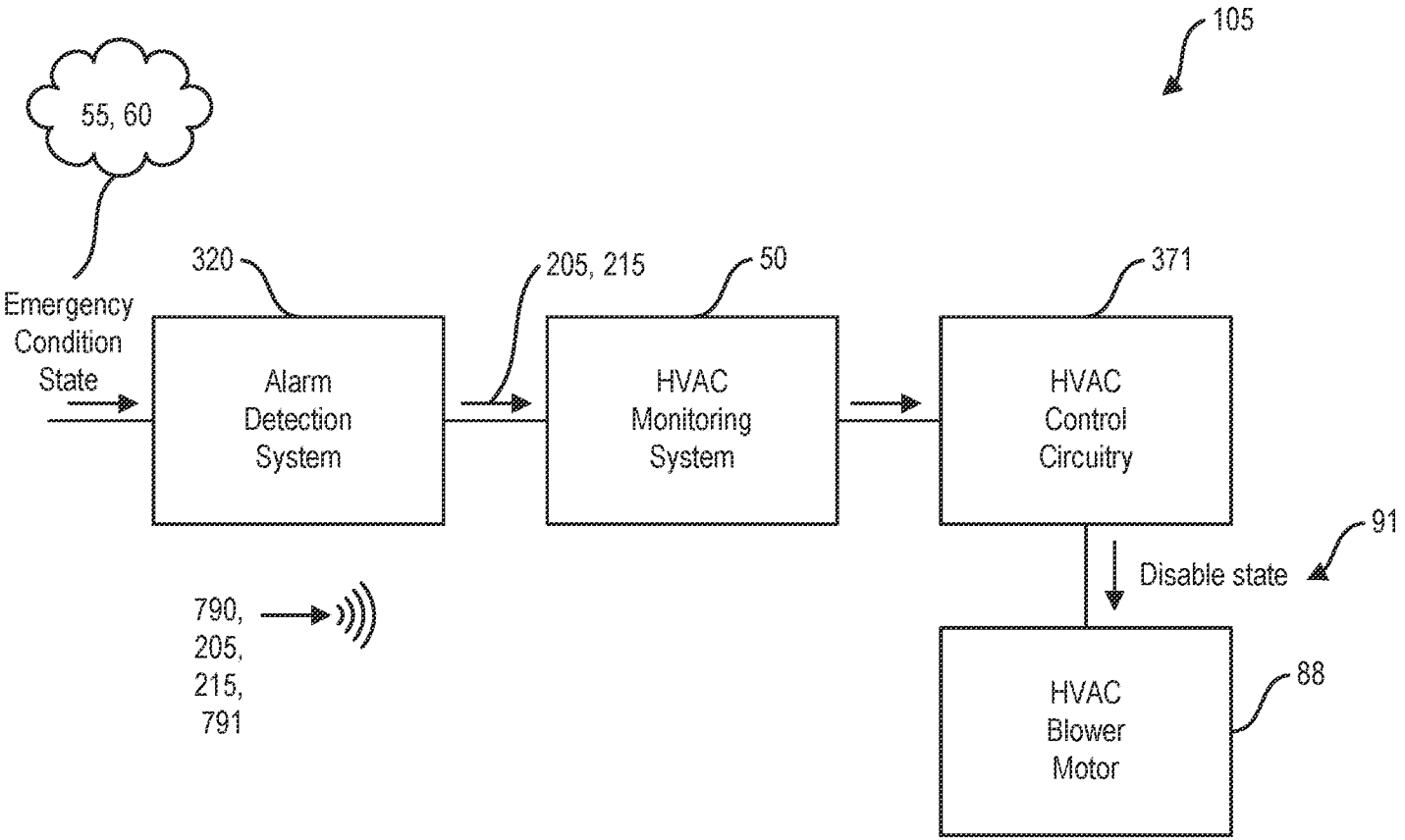
FIG. 2 shows a summary schematic diagram of the HVAC monitoring system in the emergency environmental condition state with the HVAC blower motor in the disabled operational state.

Continuing, FIG. 2 shows a summary schematic diagram of the HVAC monitoring system 50 in the emergency environmental condition state 55 with the HVAC blower fan 85 motor 88 in the disabled operational state 91.

Figure 3:
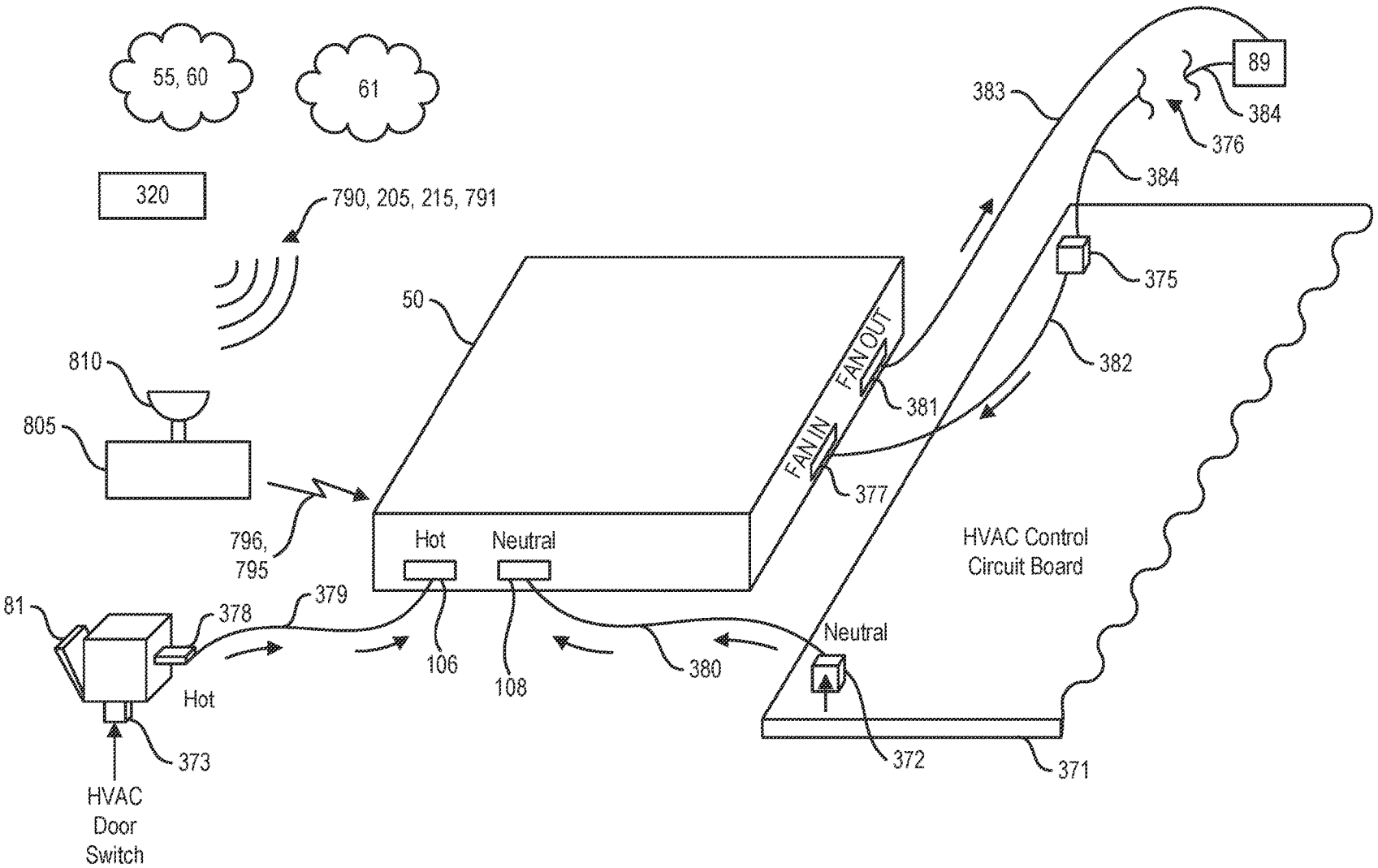
FIG. 3 shows a component/element perspective functional view of the HVAC monitoring system as a module with the interfaces to an existing HVAC door switch, an existing neutral leg connection on an existing HVAC control circuit board, in addition to an existing HVAC fan motor relay connection, and an existing relay of the existing HVAC fan motor, further a wireless signal from an existing sensor to an audio frequency sensor that is in electrical communication with a programmable radio frequency transmitter that is in wireless communication with the HVAC monitoring system as a module.

Further, FIG. 3 shows a component/element perspective functional view of the HVAC monitoring system 50 as a module 50 with the interfaces to an existing HVAC door switch 81, an existing neutral leg connection 372 on an existing HVAC control circuit board 371, in addition to an existing HVAC fan 85 motor 88 relay connection, and an existing relay 89 of the existing HVAC fan 85 motor 88, further a wireless signal 790, 791 from an existing sensor 320 to an audio frequency sensor 810 that is in electrical communication with a programmable radio frequency transmitter 805 that is in wireless communication 795, 796 with the HVAC monitoring system 50 as a module 50.

Figure 4:
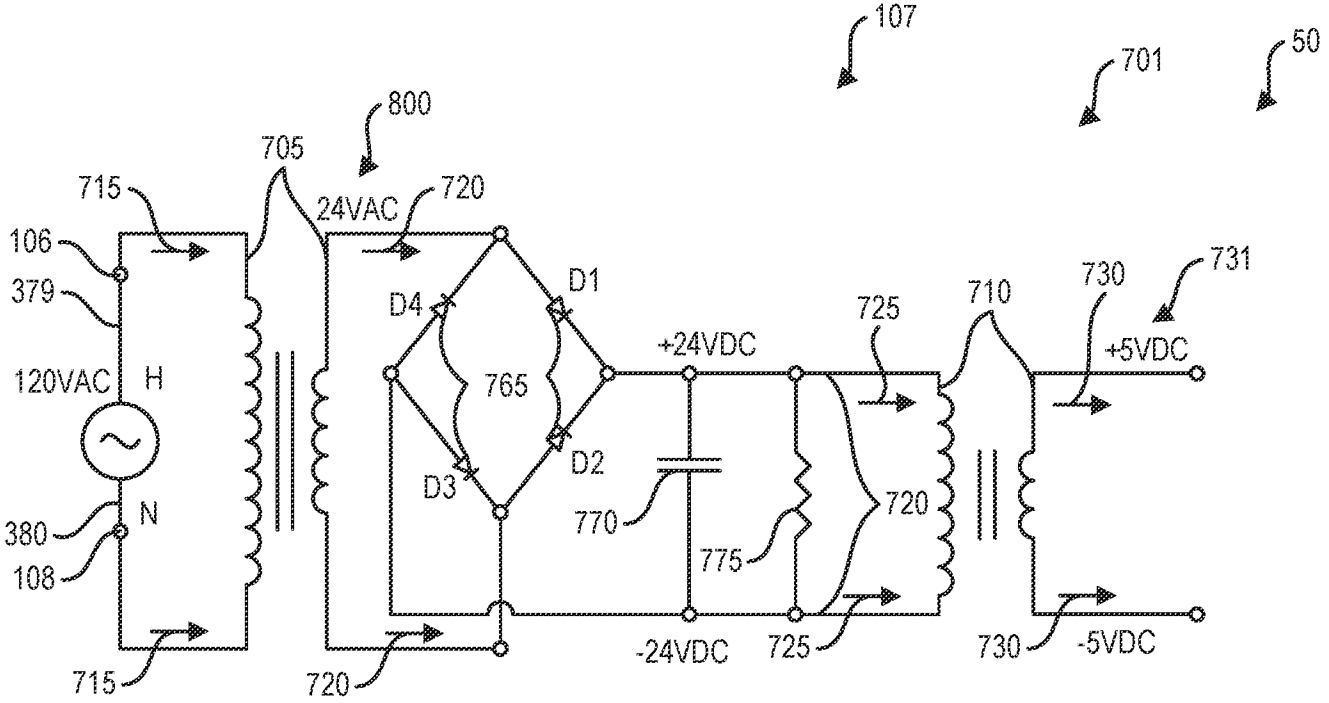
FIG. 4 shows an electrical schematic of a power supply circuitry of the HVAC monitoring system that includes an existing 120 VAC electrical power supply that is in electrical communication with a first buck converter transformer that is in electrical communication with a full wave bridge rectifier that is in electrical communication with a smoothing capacitor and a voltage control resistor providing electrical power for an existing HVAC control circuit board, wherein the smoothing capacitor and the voltage control resistor are also further in electrical communication with a second buck converter transformer providing printed circuit board power.

Moving onward, FIG. 4 shows an electrical schematic of a power supply circuitry 107 of the HVAC monitoring system 50 that includes an existing 120 VAC electrical power supply 397, 380 that is in electrical communication 715 with a first buck converter transformer 705 that is in electrical communication 720 with a full wave bridge rectifier 765 that is in electrical communication with a smoothing capacitor 770 and a voltage control resistor 775 providing electrical power 720, 725 for an existing HVAC control circuit board 371, wherein the smoothing capacitor 770 and the voltage control resistor 775 are also further in electrical communication 725 with a second buck converter transformer 710 providing printed circuit board power 730, 731.

Figure 5:
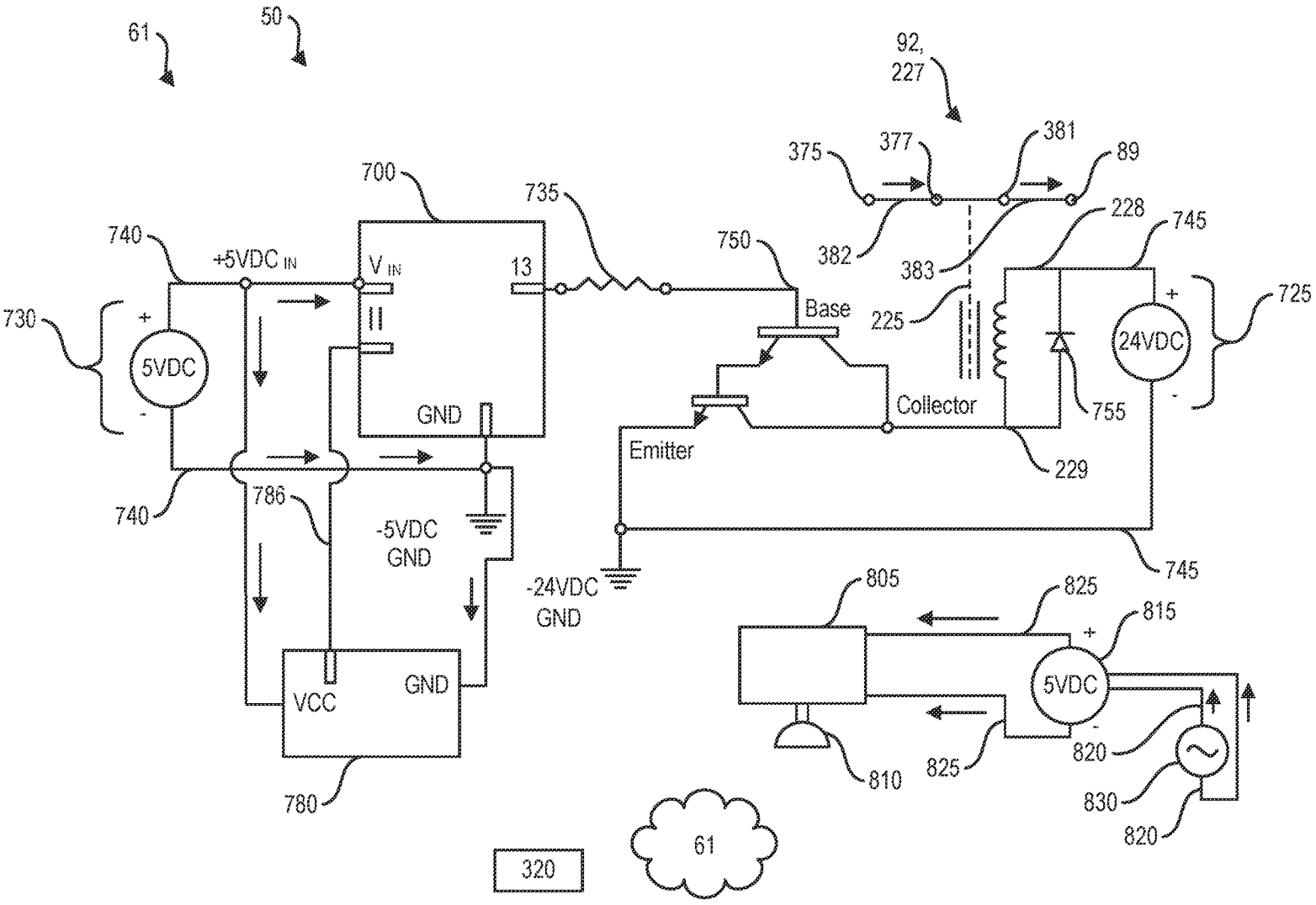
FIG. 5 shows an electrical schematic of the HVAC monitoring system in the normal environmental condition state with the relay in the closed position facilitating the activated enabled state of the existing fan blower motor with the power supply electrical schematic not shown for clarity (as the power supply electrical schematic is detailed in FIG. 4), thus shown in FIG. 5 in a summary manner, the wireless signal is not shown from the existing sensor to the audio frequency sensor (as the existing sensor in not sensing an abnormal environmental condition and thus does not create the wireless signal) the audio frequency sensor is in electrical communication with the programmable radio frequency transmitter that is in wireless communication (again this wireless communication is not shown due to no abnormal environmental condition sensed) with a programmable radio frequency receiver that is in electrical communication with a programmable control circuitry that in turn is in electrical communication with a switching transistor that is displaced between the electrical power supply for the existing HVAC control circuit board and the existing HVAC control circuit board ground, wherein in the normal environmental condition state the switching transistor is in an open operational state, thus resulting in the relay being de-energized remaining in the normally closed operational state with the HVAC blower motor in the normal enabled operational state.

Next, FIG. 5 shows an electrical schematic of the HVAC monitoring system 50 in the normal environmental condition state 61 with the relay 225 in the closed position 227 facilitating the activated enabled state 92 of the existing fan blower 85 motor 88 with the power supply electrical schematic 107 not shown for clarity (as the power supply electrical schematic 107 is detailed in FIG. 4).

Thus shown in FIG. 5 in a summary manner, is the wireless signal in not shown from the existing sensor 320 to the audio frequency sensor 810 that is in a second electrical communication 230 with the programmable radio frequency transmitter 805 that is in wireless communication (not shown) with a programmable radio frequency receiver 780 that is in electrical communication 786 with a programmable control circuitry 700 that in turn is in a fifth electrical communication 761 with a switching transistor 750 that is displaced between the electrical power supply 725 for the existing HVAC control circuit board 371 and the existing HVAC control circuit board 371 ground, wherein in the normal environmental condition state 61 the switching transistor 750 is in the open operational state thus resulting in the relay 225 being de-energized 227 remaining in the normally closed operational state with the HVAC blower 85 motor 88 in the normal enabled operational state 92.

Figure 6:
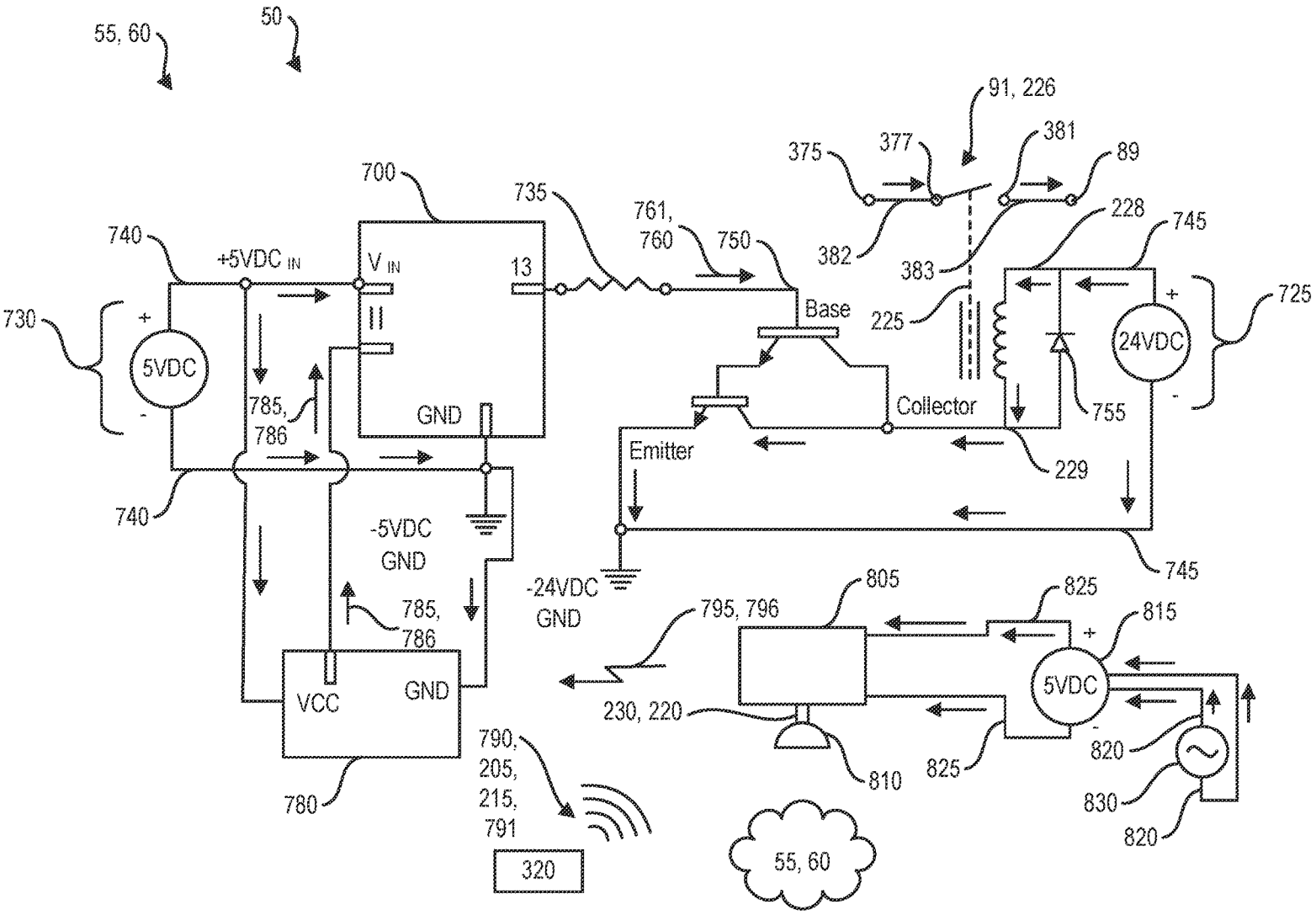

Continuing, FIG. 6 shows an electrical schematic of the HVAC monitoring system 50 from FIG. 5, wherein FIG. 6 is in the alternative environmental abnormal condition state 55, 60 with the relay 225 in the open position 226 facilitating the disabled state 91 of the existing fan blower 85 motor 88 with the power supply electrical schematic 107 not shown for clarity (as the power supply electrical schematic 107 is detailed in FIG. 4), thus shown in FIG. 6 in a summary manner is the wireless signal 790, 791 from the existing sensor 320 to the audio frequency sensor 810 that is in the second electrical communication 220, 230 with the programmable radio frequency transmitter 805 that is in wireless communication 795, 796 with the programmable radio frequency receiver 780 that is in electrical communication 785, 786 with the programmable control circuitry 700 that in turn is in the fifth electrical communication 760, 761 with the switching transistor 750 that is displaced between the electrical power supply 725 for the existing HVAC control circuit board 371 and the existing HVAC control circuit board 371 ground, wherein in the alternative environmental abnormal condition state 55, 60 the switching transistor 750 is closed thus resulting in the relay 225 being energized 226 thus the relay 225 being moved to the open operational state 226 resulting in the HVAC blower 85 motor 88 in the disabled operational state 91.

Figure 7:
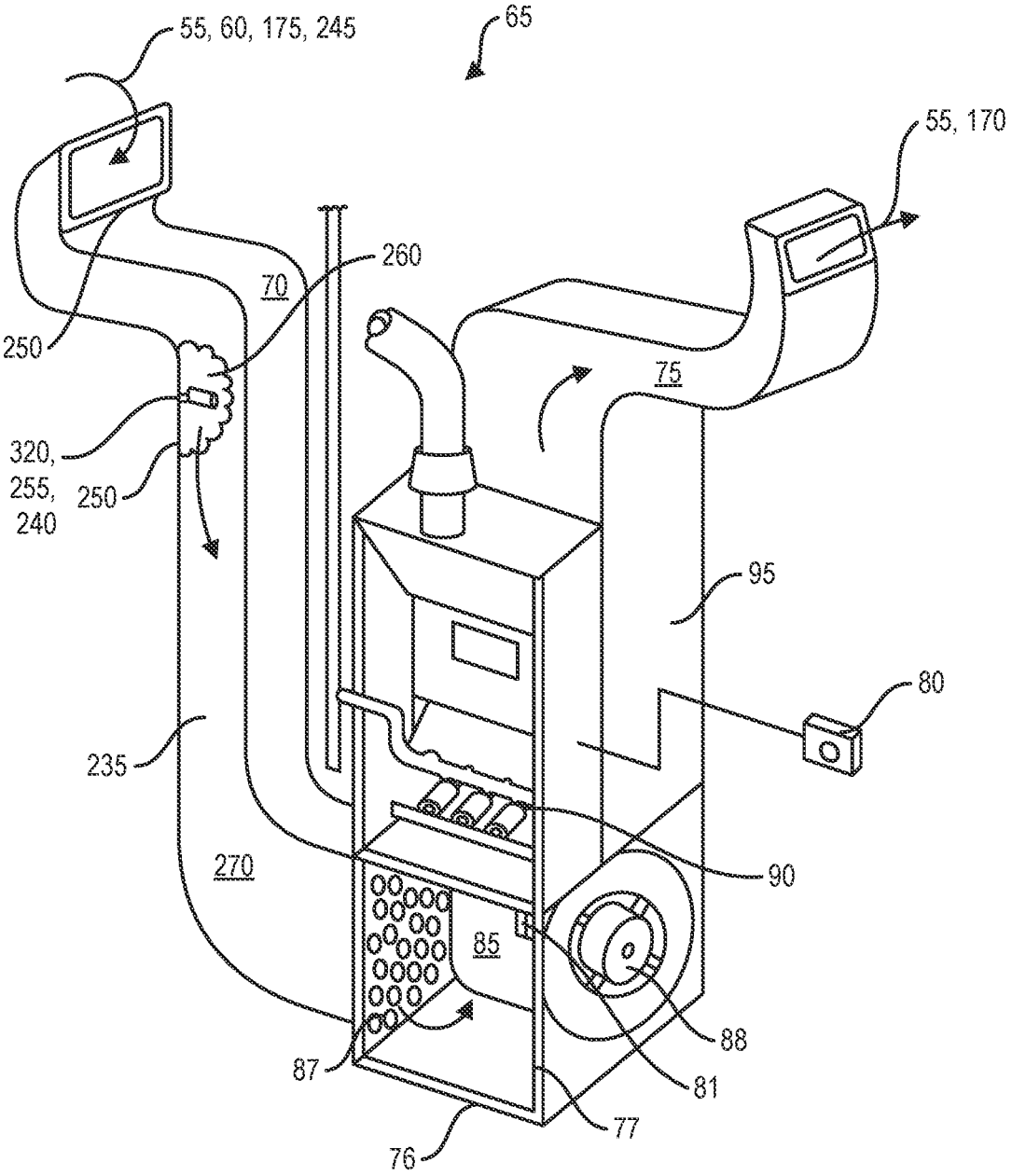
FIG. 7 shows an upper perspective view of a complete HVAC building system that includes a return duct, an exit duct, a thermostat, a heating element, a cooling element, a fan, and a fan motor, further shown is the existing sensor with a probe extension to show in context the possible typical existing sensor mounting with the HVAC building system, however noting that the existing sensor does not have to be mounted on an HVAC building system as the existing sensor can be located anywhere proximate to the building.

Moving onward, FIG. 7 shows an upper perspective view of a complete HVAC building system 65 that includes a return duct 70, an exit duct 75, a thermostat 80, a heating element 90, a cooling element 95, a fan/blower 85, and a fan motor 88, further shown is the existing sensor 320 with a probe extension 255 to show in context the possible typical existing sensor 320 mounting with the HVAC building system 65, however noting that the existing sensor 320 does not have to be mounted on an HVAC building system 65 as the existing sensor 320 can be located anywhere proximate to the building 165.

Figure 8:
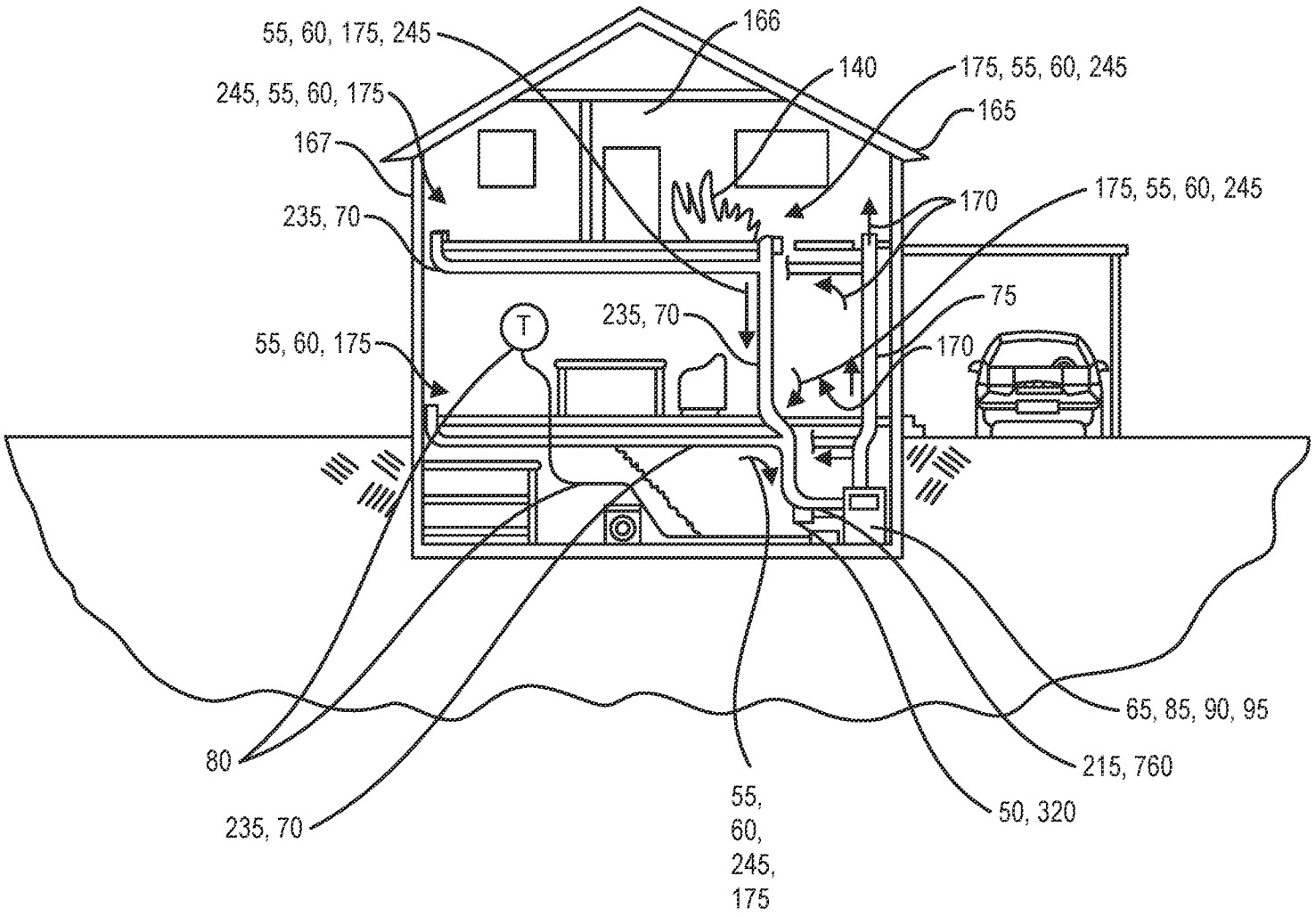
FIG. 8 shows a side elevation cross section of a use and installed drawing of the HVAC monitoring system, wherein the building is a typical residential structure with a basement, main floor, and a second story. Further, in FIG. 8 the residential structure shows a building system in the form of a typical heating ventilation and cooling system (HVAC) in the basement with HVAC floor by floor air outlets shown and HVAC floor by floor air inlets shown throughout the residential structure as is also typical. Further shown in FIG. 8 are the return and exit ducts, wherein specifically the existing sensor is shown mounted in the return duct, wherein operationally if a fire occurs as shown on the second floor, the existing sensor can detect smoke in the return duct and generate a first event marker signal through a first communication with the programmable audio frequency sensor that concurrently generates a second event market signal through the second communication to the programmable radio frequency transmitter that generates a third event marker signal that wireless transmits along a third communication to the programmable radio frequency receiver that outputs a fourth event marker signal along a fourth electrical communication to the programmable control circuitry that outputs a fifth event marker signal along a fifth electrical communication to the switching transistor that closes the switching transistor from being open, wherein the closed switching transistor activates the relay from the normally closed state to the open state thus resulting in deactivating the motor and blower of the typical heating ventilation and cooling system (HVAC), to stop the circulation of air at the return duct inlets and exit duct outlets to help prevent feeding the fire oxygen, to stop the HVAC building system from trying to cool the residential structure, and to help prevent the circulation of toxic smoke throughout the residential building structure to lessen the negative effects of the fire.

Further, FIG. 8 shows a side elevation cross section of a use and installed drawing of the HVAC monitoring system 50, wherein the building 165 is a typical residential structure 165 with a basement, main floor, and a second story. Further, in FIG. 8 the residential structure 165 shows a building system in the form of a typical heating ventilation and cooling system 65 (HVAC) in the basement with HVAC floor by floor air outlets 170 shown and HVAC floor by floor air inlets 175 shown throughout the residential structure 165 as is also typical.

Further shown in FIG. 8 are the return 175 and exit ducts 170, wherein specifically the existing sensor 320 is shown mounted in the return duct, wherein operationally if a fire 140 occurs as shown on the second floor, the existing sensor 320 can detect smoke 245 in the return duct 235 and generate a first event marker signal 205 through a first communication 215 with the programmable audio frequency sensor 810 that concurrently generates a second event market signal 220 through the second communication 230 to the programmable radio frequency transmitter 805 that generates a third event marker signal 795 that wireless transmits along a third communication 796 to the programmable radio frequency receiver 780 that outputs a fourth event marker signal 785 along a fourth electrical communication 786 to the programmable control circuitry 700 that outputs a fifth event marker signal 760 along a fifth electrical communication 761 to the switching transistor 750 that closes the switching transistor 750 from being open.

FIG. 8 shows that the closed switching transistor 750 activates 226 the relay 225 from the normally closed state 227 to the open state 226 thus resulting in deactivating 91 the motor 88 and blower/fan 85 of the typical heating ventilation and cooling system 65 (HVAC), to stop the circulation of air 175 at the return duct inlets 175 and exit duct outlets 170 to help prevent feeding the fire 140 oxygen, to stop the HVAC building system 65 from trying to cool the residential structure 165, and to help prevent the circulation of toxic smoke throughout the residential building structure 165 to lessen the negative effects of the fire 140.

Broadly, the present invention is an HVAC monitoring system 50, that tests for an environmental abnormal condition 60 defined as an event marker, utilizing an existing sensor 320 that outputs an available first event marker signal 205 along a first communication 215 when detecting the environmental abnormal condition 60, wherein the environmental abnormal condition 60 through the HVAC monitoring system 50 effectuates a selected response 105 from an existing HVAC building system 65 that includes an existing HVAC control circuit board 371 with an electrical utility alternating current neutral wire leg 372 and a fan door switch 81 with an electrical utility alternating current hot wire leg 373, see in particular FIGS. 1 to 3.

The HVAC monitoring system 50 includes a first electrical power supply 701 that receives an alternating current supply system electrical power switched hot leg 378, 379 from the HVAC fan door switch 81 and an electrical utility alternating current neutral wire leg 372 from the existing HVAC control circuit board 371, the first electrical power supply 701 includes a first electrical buck convertor transformer 705 receiving the switched hot leg 379 and the neutral wire leg 372, wherein the first electrical buck convertor transformer 705 outputs a first reduced alternating current voltage 720, 800 with the reduced voltage 720 being compatible with electrical power requirements of the existing HVAC control circuit board 371, see FIGS. 3 and 4.

The first electrical power supply 701 further includes a full wave bridge rectifier circuit 765 with a wave smoothing capacitor 770 and resistor 775 for more consistent voltage resulting in an output 725 that converts the first reduced alternating current voltage 720 to a first reduced voltage direct current 725 to be more fully compatible with electrical power requirements of the existing HVAC control circuit board, 371, see FIGS. 3, 4, 5, and 6. The first electrical power supply 701 also includes a second electrical buck convertor transformer 710 receiving the existing HVAC control circuit board 371 compatible reduced voltage direct current 725, wherein the second electrical buck convertor transformer 710 outputs a second reduced direct current voltage 730 with the second reduced direct current voltage 730 being compatible with electrical power requirements of a semiconductor printed circuit board, see FIG. 4.

Further included in the HVAC monitoring system is a second electrical power supply 815 that is adapted to receive alternating current supply electrical power 820 from a building wall electrical outlet, the second electrical power supply 815 outputs a third reduced direct current voltage 825 with the third reduced direct current voltage 825 being compatible with electrical power requirements of a semiconductor printed circuit board, see FIGS. 5 and 6. Also, a programmable audio frequency sensor 810 that receives input electrical power from the third reduced direct current voltage 825, operationally the programmable audio frequency sensor 810 scans for the environmental abnormal condition 60 as indicated by the existing sensor 320 that outputs the available first event marker signal 205, wherein the programmable audio frequency sensor 810 is operative to monitor for the available first event marker signal 205 and when the first event marker signal 205 is received results in the programmable audio frequency sensor 810 outputting a second event marker signal 220 along a second communication 230, see FIGS. 3 and 6.

Additionally included in the HVAC monitoring system 50 is a programmable radio frequency transmitter 805 that receives input electrical power from the third reduced direct current voltage 825, the programmable radio frequency transmitter 805 is operative to monitor for the second event marker signal 220 and when the second event marker signal 220 is received results in the programmable radio frequency transmitter 805 outputting a third event marker signal 795 along a third communication 796, see FIGS. 3 and 6.

Further, a programmable radio frequency receiver 780 that receives input electrical power from the second reduced direct current voltage 731, the programmable radio frequency receiver 780 is operative to monitor the third event marker signal 795 and when the third event marker signal 795 is received results in the programmable radio frequency receiver 780 outputting a fourth event marker signal 785 along a fourth communication 786, see FIG. 6. In addition, programmable control circuitry 700 that receives input electrical power from the second reduced direct current voltage 731, the programmable control circuitry 700 is in a ready state being operative to monitor for the fourth event marker signal 785 and when the fourth event marker signal 785 is received results in the control circuitry 700 outputting a fifth event marker signal 760 along a fifth communication 761, see FIG. 6.

Further included in the HVAC monitoring system 50 is a switching transistor 750 having a base connection, a collector connection, and an emitter connection, the base connection is in electrical communication with the fifth communication 761 and is operative to receive the fifth event marker signal 760 and when the fifth event marker signal 760 is received results in the collector connection and the emitter connection being placed from a transistor 750 open electrical communication state to a transistor 750 closed electrical communication state to facilitate electrical communication from the collector connection to the emitter connection, see FIGS. 5 and 6. Continuing, a normally closed electrical relay 225 that receives input electrical power from the first reduced voltage direct current 725 being a positive leg only to a primary terminal 228 of the normally closed electrical relay 225, wherein the first reduced voltage direct current 725 being compatible with the electrical power requirements of the existing HVAC control circuit board 371, See FIGS. 5 and 6.

The normally closed electrical relay 225 is also in electrical communication to the switching transistor 750 collector connection through a secondary terminal 229 on the normally closed electrical relay 225, the normally closed electrical relay 225 switched leg is disposed in electrical communication as between an existing HVAC control circuit board 371 fan relay output connector 375 and an existing HVAC fan/blower 85 motor 88 relay 89 resulting in operationally the normally closed electrical relay 225 controlling building 165 full voltage alternating current electrical power 830 to an existing HVAC fan/blower 85 motor 88 that results in the existing HVAC fan/blower 85 motor 88 being operational when the normally closed electrical relay 225 is in an un-activated operational state such that the normally closed electrical relay 225 is in a closed state, see in particular FIG. 5.

When the normally closed electrical relay 225 is in an activated operational state 226 from allowing electrical communication from the secondary terminal 229 to a negative ground of the first reduced voltage direct current 725 therethrough the collector connection to the emitter connection, resulting in the normally closed electrical relay 225 switched leg moving to an open state 226 resulting in the existing HVAC fan/blower 85 motor 88 being deactivated 91, see in particular FIG. 6.

As an option for the HVAC monitoring system 50, wherein the programmable audio frequency sensor 810 can further include enhanced sensor structure for detecting the environment abnormal condition 60 that is selected from the group consisting of ambient temperature, smoke ionization, smoke optical, smoke photoelectric, catalytic combustible gas sensor for; natural gas, hydrogen, or propane, a carbon monoxide detector, or an ultraviolet infrared flame detector, for the environmental abnormal condition 60 as indicated by the enhanced sensor structure resulting in outputting the second event marker signal 220 along the second communication 230, see FIGS. 3 and 6.

Another option for the HVAC monitoring system 50, wherein the programmable radio frequency receiver 780 through the third event marker signal 795 is programmed to filter frequencies of the third even marker signal 795 to only allow frequencies that have a high reliability for indicating the environmental abnormal condition 60 from the existing sensor 320, prior to the programmable radio frequency receiver 780 outputting the fourth event marker signal 785 along a fourth communication 786, see FIG. 6.

A further option for the HVAC monitoring system 50, wherein the programmable audio frequency sensor 810 is programmed to pair with the programmable radio frequency transmitter 805 with the programmable audio frequency sensor 810 is programmed to measure peak frequency values within a selected range using a Fourier transform function to enable the programmable radio frequency transmitter 805 through the third event marker signal 795 to only transmit the selected range peak frequency values to the programmable radio frequency receiver 780 to better have the programmable audio frequency sensor 810 detect the environmental abnormal condition 60 as indicated by the existing sensor 320 that outputs the available first event marker signal 205, see FIG. 6.

Alternatively, for the HVAC monitoring system 50, wherein the selected range peak frequency values are programmed to be stored in a variable to help eliminate unintelligible values that were included in the selected range peak frequency values from the programmable audio frequency sensor 810, resulting in modified selected range peak frequency values to further better have the programmable audio frequency sensor 810 detect the environmental abnormal condition 60 as indicated by the existing sensor 320 that outputs the available first event marker signal 205, see FIG. 6.

Further, alternatively, for the HVAC monitoring system 50, wherein the programmable radio frequency receiver 780 through the third event marker signal 795 is programmed to ignore repeated selected range peak frequency values of the third event marker signal 795 to prevent repeated erroneous selected range peak frequency values as contained within the second event marker signal 220 from the programmable audio frequency sensor 810 when there was an absence of the first event market signal 205, see FIG. 6.

A method is disclosed for installing the HVAC monitoring system 50, that includes the steps of:

Providing the HVAC monitoring system 50 that includes providing the first electrical power supply 701, the second electrical power supply 815, the programmable audio frequency sensor 810, the programmable radio frequency transmitter 805, the programmable radio frequency receiver 780, the programmable control circuitry 700, the switching transistor 750, and the normally closed electrical relay 225 all as previously described in this specification.

Continuing with the installation of the HVAC monitoring system 50, with the further steps of;

Disconnecting the building electrical power 372, 373, 830 to the existing HVAC building system 65, see FIGS. 3 and 7.

Removing an existing fan door and an access panel of the existing HVAC building system 65 for access to the existing HVAC control circuit board 371 of the existing HVAC building system 65, see FIG. 7.

Locating the existing HVAC control circuit board 371 and in particular finding the existing HVAC control circuit board 371 fan relay output connector 375 that puts the existing HVAC control circuit board 371 fan relay output connector 375 in electrical communication 384 with an existing HVAC system fan motor relay 89, see in particular FIG. 3.

Disconnecting the existing HVAC fan 85 motor 88 electrical communication 384 as between the existing HVAC control circuit 371 board fan 85 relay 89 output connector 375 and the existing HVAC system 65 fan 85 motor 88 relay 89 to operationally force the existing HVAC fan 85 motor 88 electrical communication 384 through electrical communication 382 into the HVAC monitoring system 50, thus interrupting 376 the existing electrical communication 384 as between the existing HVAC control circuit board 371 fan 85 motor 88 relay 89 output connector 375 and the existing HVAC system 65 fan 85 motor 88 relay 89, see in particular FIG. 3.

Connecting the electrical communication 382 defined as Fan 1 from the existing HVAC control circuit board 371 fan 85 motor 88 relay 89 output connector 375 to an input connector 377 of the normally closed electrical relay 225, see FIGS. 3, 5, and 6.

Connecting the electrical communication 383 defined as Fan 2 from an output connector 381 of the normally closed electrical relay 225 to the existing HVAC system 65 fan 85 motor 88 relay 89, again see FIGS. 3, 5, and 6.

Locating the existing HVAC building system 65 fan door switch 81 that has two electrical communications 373, 378, identifying which of the two electrical connections 373, 378 is opposite of an electrical power feed electrical communication that is identified by tracing back the existing HVAC building system 65 building electrical power feed 106, 830, see FIGS. 3, 4, 5, and 6.

Splicing into the non-electrical power feed electrical communication 379 from the first locating step above for the fan door switch 81 with an electrical communication 379 defined as Hot 1 and connecting said Hot 1 to a building alternating current power Hot 1 input 106 on the HVAC monitoring system 50, see FIG. 3.

Locating the existing HVAC control circuit board 371 and specifically the existing HVAC building system 65 building electrical power feed 108, 830 on the existing HVAC control circuit board 371 for a neutral electrical power feed 380, see FIGS. 3, 4, 5, and 6.

Splicing into the existing HVAC control circuit board 371 for a neutral electrical power feed 372 with an electrical communication defined 380 as Neutral 1 and connecting Neutral 1 to a building alternating current power 830 Neutral 1 input on the HVAC monitoring system 50, see FIGS. 3 and 4. Wherein operationally, this allows the HVAC monitoring system 50 power input 106, 108 to be dependent upon the existing HVAC building system 65 fan door switch 81 that will deactivate the HVAC monitoring system 50 while simultaneously deactivating the existing HVAC control circuit board 371 if the existing HVAC building system 65 fan door is opened being for safety, if the existing HVAC building system 65 fan door is closed, then the HVAC monitoring system 50 will deactivate the existing HVAC building system 65 fan 85 only upon the environmental abnormal condition 60, see FIGS. 3 and 4.

If the environmental abnormal condition 60 does not exist, the HVAC monitoring system 50 allows the existing HVAC control circuit board 371 to control the existing HVAC building system 65 fan 85 normally, as the existing HVAC system 65 fan 85 motor 88 relay connection 375 on the HVAC control circuit board 371 is in direct electrical communication 382, 383 with the existing HVAC building system 65 fan 85 motor 88 relay, as the normally closed electrical relay 225 remains in a closed electrical state 92, 227, see FIG. 5, allowing the existing HVAC control circuit board 371 to control the existing HVAC building system 65 fan 85 normally, see FIGS. 3, 4, and 5.

Plugging in the second electrical power supply 815 to the building wall outlet 830 to supply the third reduced direct current voltage 825 to the programmable audio frequency sensor 810 and the programmable radio frequency transmitter 805, this is to operationally allow the programmable audio frequency sensor 810 and the programmable radio frequency transmitter 805 to be wirelessly remote from the first electrical power supply 701, the programmable radio frequency receiver 780, the programmable control circuitry 700, the switching transistor 750, and the normally closed electrical relay 225, see FIGS. 3, 4, 5, and 6.

Incorporation by reference into the specification for the three groups of source code as follows:

Source code—concurrently submitted as three ASCII text files;

Files description: Source code for the code of the patent application relating to the programmable radio frequency receiver 780, the programmable radio frequency transmitter

805, and the relay 225.

First source code file;

Reference element number; programmable radio frequency receiver 780

File name: ReceiverSC

File Format: SourceCodeASCII

File size (KB): 2

Pages 2

File creation date: May 7, 2022

Authors: Adam Roller, Kathryn Huonder, and Tariq Al Salmani

Purpose: to filter out false positive values of frequency from the programmable audio frequency sensor 810 to help prevent false activation 226 of the relay 225

Second source code file;

Reference element number; programmable radio frequency transmitter 805

File Name: TransmitterSC

File Format: SourceCodeASCII

File size (KB): 3

Pages 3

File creation date: May 7, 2022

Authors: Adam Roller, Kathryn Huonder, and Tariq Al Salmani

Purpose: to measure peak frequency values within a selected range using a Fourier transform function to only transmit selected peak frequency values (to help eliminate unintelligible frequency values and repeated frequency values) to the programmable radio frequency receiver 780 to better and more accurately detect the environmental abnormal condition 60

Third source code file;

Reference element number; relay 225

File Name: RelayOutSC

File Format: SourceCodeASCII

File size (KB): 1

Pages 2

File creation date: May 7, 2022

Authors: Adam Roller, Kathryn Huonder, and Tariq Al Salmani

Purpose: to manually test relay 225 activation 226 for existing HVAC building system 65 fan/blower 85 motor 88 disabling 91

CONCLUSION

Accordingly, the present invention of an HVAC monitoring system has been described with some degree of particularity directed to the embodiments of the present invention. It should be appreciated, though, that the present invention is defined by the following claims construed in light of the prior art so modifications or changes may be made to the exemplary embodiments of the present invention without departing from the inventive concepts contained therein.

The invention claimed is:

1. An HVAC monitoring system that tests for an environmental abnormal condition defined as an event marker, utilizing an existing sensor that outputs an available first event marker signal along a first communication when detecting the environmental abnormal condition, wherein the environmental abnormal condition through said HVAC monitoring system effectuates a selected response from an existing HVAC building system that includes an existing HVAC control circuit board with an electrical utility alternating current neutral wire leg and a fan door switch with an electrical utility alternating current hot wire leg, said HVAC monitoring system comprising:

(a) a first electrical power supply that receives an alternating current supply system electrical power switched hot leg from the HVAC fan door switch and an electrical utility alternating current neutral wire leg from the existing HVAC control circuit board, said first electrical power supply includes a first electrical buck convertor transformer receiving the switched hot leg and the neutral wire leg, wherein said first electrical buck convertor transformer outputs a first reduced alternating current voltage with said reduced voltage being compatible with electrical power requirements of the existing HVAC control circuit board, said first electrical power supply further includes a full wave bridge rectifier circuit with a wave smoothing capacitor and resistor for more consistent voltage resulting in an output that converts said first reduced alternating current voltage to a first reduced voltage direct current to be more fully compatible with electrical power requirements of the existing HVAC control circuit board, said first electrical power supply also includes a second electrical buck convertor transformer receiving said existing HVAC control circuit board compatible reduced voltage direct current, wherein said second electrical buck convertor transformer outputs a second reduced direct current voltage with said second reduced direct current voltage being compatible with electrical power requirements of a semiconductor printed circuit board;

(b) a second electrical power supply that is adapted to receive alternating current supply electrical power from a building wall electrical outlet, said second electrical power supply outputs a third reduced direct current voltage with said third reduced direct current voltage being compatible with electrical power requirements of a semiconductor printed circuit board;

(c) a programmable audio frequency sensor that receives input electrical power from said third reduced direct current voltage, operationally said programmable audio frequency sensor scans for the environmental abnormal condition as indicated by the existing sensor that outputs the available first event marker signal, wherein said programmable audio frequency sensor is operative to monitor for the available first event marker signal and when said first event marker signal is received results in said programmable audio frequency sensor outputting a second event marker signal along a second communication;

(d) a programmable radio frequency transmitter that receives input electrical power from said third reduced direct current voltage, said programmable radio frequency transmitter is operative to monitor for said second event marker signal and when said second event marker signal is received results in said programmable radio frequency transmitter outputting a third event marker signal along a third communication;

(e) a programmable radio frequency receiver that receives input electrical power from said second reduced direct current voltage, said programmable radio frequency receiver is operative to monitor said third event marker signal and when said third event marker signal is received results in said programmable radio frequency receiver outputting a fourth event marker signal along a fourth communication;

(f) programmable control circuitry that receives input electrical power from said second reduced direct current voltage, said programmable control circuitry is in a ready state being operative to monitor for said fourth event marker signal and when said fourth event marker signal is received results in said control circuitry outputting a fifth event marker signal along a fifth communication;

(g) a switching transistor having a base connection, a collector connection, and an emitter connection, said base connection is in electrical communication with said fifth communication and is operative to receive said fifth event marker signal and when said fifth event marker signal is received results in said collector connection and said emitter connection being placed from a transistor open electrical communication state to a transistor closed electrical communication state to facilitate electrical communication from said collector connection to said emitter connection; and (h) a normally closed electrical relay that receives input electrical power from said first reduced voltage direct current being a positive leg only to a primary terminal of said normally closed electrical relay, wherein said first reduced voltage direct current being compatible with the electrical power requirements of the existing HVAC control circuit board, said normally closed electrical relay is also in electrical communication to said switching transistor collector connection through a secondary terminal on said normally closed electrical relay, said normally closed electrical relay switched leg is disposed in electrical communication as between an existing HVAC control circuit board fan relay output connector and an existing HVAC fan motor relay resulting in operationally said normally closed electrical relay controlling building full voltage alternating current electrical power to an existing HVAC fan motor that results in the existing HVAC fan motor being operational when said normally closed electrical relay is in an un-activated operational state such that said normally closed electrical relay is in a closed state, and when said normally closed electrical relay is in an activated operational state from allowing electrical communication from said secondary terminal to a negative ground of said first reduced voltage direct current therethrough said collector connection to said emitter connection, resulting in said normally closed electrical relay switched leg moving to an open state resulting in the existing HVAC fan motor being deactivated.

2. An HVAC monitoring system according to claim 1 wherein said a programmable audio frequency sensor can further include enhanced sensor structure for detecting the environment abnormal condition that is selected from the group consisting of ambient temperature, smoke ionization, smoke optical, smoke photoelectric, catalytic combustible gas sensor for; natural gas, hydrogen, or propane, a carbon monoxide detector, or an ultraviolet infrared flame detector, for the environmental abnormal condition as indicated by said enhanced sensor structure resulting in outputting said second event marker signal along said second communication.

3. An HVAC monitoring system according to claim 1 wherein said programmable radio frequency receiver through said third event marker signal is programmed to filter frequencies of said third even marker signal to only allow frequencies that have a high reliability for indicating the environmental abnormal condition from the existing sensor, prior to said programmable radio frequency receiver outputting said fourth event marker signal along a fourth communication.

4. An HVAC monitoring system according to claim 1 wherein said programmable audio frequency sensor is programmed to pair with said programmable radio frequency transmitter with said programmable audio frequency sensor is programmed to measure peak frequency values within a selected range using a Fourier transform function to enable said programmable radio frequency transmitter through said third event marker signal to only transmit said selected range peak frequency values to said programmable radio frequency receiver to better have said programmable audio frequency sensor detect the environmental abnormal condition as indicated by the existing sensor that outputs the available first event marker signal.

5. An HVAC monitoring system according to claim 4 wherein said selected range peak frequency values are programmed to be stored in a variable to help eliminate unintelligible values that were included in said selected range peak frequency values from said programmable audio frequency sensor, resulting in modified selected range peak frequency values to further better have said programmable audio frequency sensor detect the environmental abnormal condition as indicated by the existing sensor that outputs the available first event marker signal.

6. An HVAC monitoring system according to claim 5 wherein said programmable radio frequency receiver through said third event marker signal is programmed to ignore repeated selected range peak frequency values of said third event marker signal to prevent repeated erroneous selected range peak frequency values as contained within said second event marker signal from said programmable audio frequency sensor when there was an absence of said first event market signal.

7. A method for installing an HVAC monitoring system that tests for an environmental abnormal condition defined as an event marker, utilizing an existing sensor that outputs an available first event marker signal along a first communication when detecting the environmental abnormal condition, wherein the environmental abnormal condition through said HVAC monitoring system effectuates a selected response from an existing HVAC building system that includes an existing HVAC control circuit board with an electrical utility alternating current neutral wire leg and a fan door switch with an electrical utility alternating current hot wire leg, said method for installing an HVAC monitoring system comprises the steps of:

(a) providing a first electrical power supply that receives an alternating current supply system electrical power switched hot leg from the HVAC fan door switch and an electrical utility alternating current neutral wire leg from the existing HVAC control circuit board, said first electrical power supply includes a first electrical buck convertor transformer receiving the switched hot leg and the neutral wire leg, wherein said first electrical buck convertor transformer outputs a first reduced alternating current voltage with said reduced voltage being compatible with electrical power requirements of the existing HVAC control circuit board, said first electrical power supply further includes a full wave bridge rectifier circuit with a wave smoothing capacitor and resistor for more consistent voltage resulting in an output that converts said first reduced alternating current voltage to a first reduced voltage direct current to be more fully compatible with electrical power requirements of the existing HVAC control circuit board, said first electrical power supply also includes a second electrical buck convertor transformer receiving said existing HVAC control circuit board compatible reduced voltage direct current, wherein said second electrical buck convertor transformer outputs a second reduced direct current voltage with said second reduced direct current voltage being compatible with electrical power requirements of a semiconductor printed circuit board;

(b) providing a second electrical power supply that is adapted to receive alternating current supply electrical power from a building wall electrical outlet, said second electrical power supply outputs a third reduced direct current voltage with said third reduced direct current voltage being compatible with electrical power requirements of a semiconductor printed circuit board;

(c) providing a programmable audio frequency sensor that receives input electrical power from said third reduced direct current voltage, operationally said programmable audio frequency sensor scans for the environmental abnormal condition as indicated by the existing sensor that outputs the available first event marker signal, wherein said programmable audio frequency sensor is operative to monitor for the available first event marker signal and when said first event marker signal is received results in said programmable audio frequency sensor outputting a second event marker signal along a second communication;

(d) providing a programmable radio frequency transmitter that receives input electrical power from said third reduced direct current voltage, said programmable radio frequency transmitter is operative to monitor for said second event marker signal and when said second event marker signal is received results in said programmable radio frequency transmitter outputting a third event marker signal along a third communication;

(e) providing a programmable radio frequency receiver that receives input electrical power from said second reduced direct current voltage, said programmable radio frequency receiver is operative to monitor said third event marker signal and when said third event marker signal is received results in said programmable radio frequency receiver outputting a fourth event marker signal along a fourth communication;

(f) providing programmable control circuitry that receives input electrical power from said second reduced direct current voltage, said programmable control circuitry is in a ready state being operative to monitor for said fourth event marker signal and when said fourth event marker signal is received results in said control circuitry outputting a fifth event marker signal along a fifth communication;

(g) providing a switching transistor having a base connection, a collector connection, and an emitter connection, said base connection is in electrical communication with said fifth communication and is operative to receive said fifth event marker signal and when said fifth event marker signal is received results in said collector connection and said emitter connection being placed from a transistor open electrical communication state to a transistor closed electrical communication state to facilitate electrical communication from said collector connection to said emitter connection;

(h) providing a normally closed electrical relay that receives input electrical power from said first reduced voltage direct current being a positive leg only to a primary terminal of said normally closed electrical relay, wherein said first reduced voltage direct current being compatible with the electrical power requirements of the existing HVAC control circuit board, said normally closed electrical relay is also in electrical communication to said switching transistor collector connection through a secondary terminal on said normally closed electrical relay, said normally closed electrical relay switched leg is disposed in electrical communication as between an existing HVAC control circuit board fan relay output connector and an existing HVAC fan motor relay resulting in operationally said normally closed electrical relay controlling building full voltage alternating current electrical power to an existing HVAC fan motor that results in the existing HVAC fan motor being operational when said normally closed electrical relay is in an un-activated operational state such that said normally closed electrical relay is in a closed state, and when said normally closed electrical relay is in an activated operational state from allowing electrical communication from said secondary terminal to a negative ground of said first reduced voltage direct current therethrough said collector connection to said emitter connection, resulting in said normally closed electrical relay switched leg moving to an open state resulting in the existing HVAC fan motor being deactivated;

(i) disconnecting building electrical power to the existing HVAC building system;

(j) removing an existing fan door and an access panel for the existing HVAC control circuit board both from the existing HVAC building system;

(k) locating the existing HVAC control circuit board and in particular finding the existing HVAC control circuit board fan relay output connector that puts the existing HVAC control circuit board fan relay output connector in electrical communication with an existing HVAC system fan motor relay;

(l) disconnecting an existing HVAC fan motor electrical communication as between the existing HVAC control circuit board fan relay output connector and the existing HVAC system fan motor relay to operationally force the existing HVAC fan motor electrical communication through said HVAC monitoring system, thus interrupting the existing electrical communication as between the existing HVAC control circuit board fan relay output connector and the existing HVAC system fan motor relay;

(m) connecting an electrical communication defined as Fan 1 from the existing HVAC control circuit board fan relay output connector to an input connector of said normally closed electrical relay;

(n) connecting an electrical communication defined as Fan 2 from an output connector of said normally closed electrical relay to the existing HVAC system fan motor relay;

(o) locating the existing HVAC building system fan door switch that has two electrical communications, identifying which of the two electrical connections is opposite of an electrical power feed electrical communication that is identified by tracing back the existing HVAC building system building electrical power feed;

(p) splicing into the non-electrical power feed electrical communication from said step (o) with an electrical communication defined as Hot 1 and connecting said Hot 1 to a building alternating current power Hot 1 input on said HVAC monitoring system;

(q) locating the existing HVAC control circuit board and specifically the existing HVAC building system building electrical power feed on the existing HVAC control circuit board for a neutral electrical power feed;

(r) splicing into the existing HVAC control circuit board for a neutral electrical power feed with an electrical communication defined as Neutral 1 and connecting said Neutral 1 to a building alternating current power Neutral 1 input on said HVAC monitoring system, wherein operationally this allows said HVAC monitoring system power input to be dependent upon the existing HVAC building system fan door switch that will deactivate said HVAC monitoring system while simultaneously deactivating the existing HVAC control circuit board if the existing HVAC building system fan door is opened being for safety, if the existing HVAC building system fan door is closed, then said HVAC monitoring system will deactivate the existing HVAC building system fan only upon the environmental abnormal condition, and if the environmental abnormal condition does not exist, said HVAC monitoring system allows the existing HVAC control circuit board to control the existing HVAC building system fan normally, as the existing HVAC system fan motor relay connection on the HVAC control circuit board is in direct electrical communication with the existing HVAC building system fan motor relay, as said normally closed electrical relay remains in a closed electrical; state allowing the existing HVAC control circuit board to control the existing HVAC building system fan normally; and (s) plugging in said second electrical power supply to the building wall outlet to supply said third reduced direct current voltage to said programmable audio frequency sensor and said programmable radio frequency transmitter, this is to operationally allow said programmable audio frequency sensor and said programmable radio frequency transmitter to be wirelessly remote from said first electrical power supply, said programmable radio frequency receiver, said programmable control circuitry, said switching transistor, and said normally closed electrical relay.

* * * * *